US012442255B2

(12) United States Patent
Buntval et al.

(10) Patent No.: US 12,442,255 B2
(45) Date of Patent: Oct. 14, 2025

(54) DRILL BIT, METHOD, AND SYSTEM

(71) Applicant: Baker Hughes Oilfield Operations LLC, Houston, TX (US)

(72) Inventors: Rohan Buntval, Manvel, TX (US); Valerie Ferdin, Spring, TX (US)

( * ) Notice: Subject to any disclaimer, the term of this patent is extended or adjusted under 35 U.S.C. 154(b) by 0 days.

(21) Appl. No.: 18/486,629

(22) Filed: Oct. 13, 2023

(65) Prior Publication Data

US 2025/0122764 A1 Apr. 17, 2025

(51) Int. Cl.
*E21B 10/55* (2006.01)
*E21B 10/43* (2006.01)

(52) U.S. Cl.
CPC ..... *E21B 10/55* (2013.01); *E21B 10/43* (2013.01)

(58) Field of Classification Search
CPC ..... E21B 10/43; E21B 10/55
See application file for complete search history.

(56) References Cited

U.S. PATENT DOCUMENTS 4,499,795 A * 2/1985 Radtke ..... B22D 19/06 175/428
4,679,640 A * 7/1987 Crawford ..... C21D 9/22 175/425
4,867,015 A * 9/1989 Kane ..... B23P 15/28 76/DIG. 2
5,056,382 A * 10/1991 Clench ..... B23P 15/28 76/DIG. 12
6,568,491 B1 * 5/2003 Matthews, III ..... E21B 10/55 76/108.4
8,309,018 B2 11/2012 Smith et al.
8,322,466 B2 12/2012 Bird
2007/0157763 A1 * 7/2007 Oldham ..... B23H 9/00 76/108.2
2011/0297454 A1 12/2011 Shen et al.
2018/0038167 A1 * 2/2018 Xu ..... B28B 1/001
2023/0220733 A1 7/2023 Zhang et al.

FOREIGN PATENT DOCUMENTS

WO 2022047017 A1 3/2022

OTHER PUBLICATIONS

Notification of Transmittal of the International Search Report and the Written Opinion of the International Searching Authority, or the Declaration; PCT/US2024/050901; Mail date: Jan. 20, 2025; 10 pages.

* cited by examiner

*Primary Examiner* — D. Andrews
(74) *Attorney, Agent, or Firm* — Baker Hughes Company

(57) ABSTRACT

A method for making a drill bit, including forming a bit body with an outer surface, forming a cutter pocket in the bit body, forming a dam about the cutter pocket that is proud of the surface, hardfacing the bit body to a depth not exceeding a height of the dam. A drill bit, including a bit body having an outer surface, a cutter pocket defined in the bit body, and a dam disposed about the cutter pocket and proud of the outer surface.

13 Claims, 3 Drawing Sheets

DRILL BIT, METHOD, AND SYSTEM

BACKGROUND

Adjacent the resource recovery and fluid sequestration industries, drill bits are manufactured specifically for the purpose of creating boreholes in subsurface formations. Such bits are complicated, requiring a body, cutters, hard facing, junk slots, etc. Due to the various features required for a drill bit for this purpose, substantial work is required during manufacture. New technologies that reduce the work required are always well received by the art.

SUMMARY

An embodiment of a method for making a drill bit, including forming a bit body with an outer surface, forming a cutter pocket in the bit body, forming a dam about the cutter pocket that is proud of the surface, hardfacing the bit body to a depth not exceeding a height of the dam.

An embodiment of a drill bit, including a bit body having an outer surface, a cutter pocket defined in the bit body, and a dam disposed about the cutter pocket and proud of the outer surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
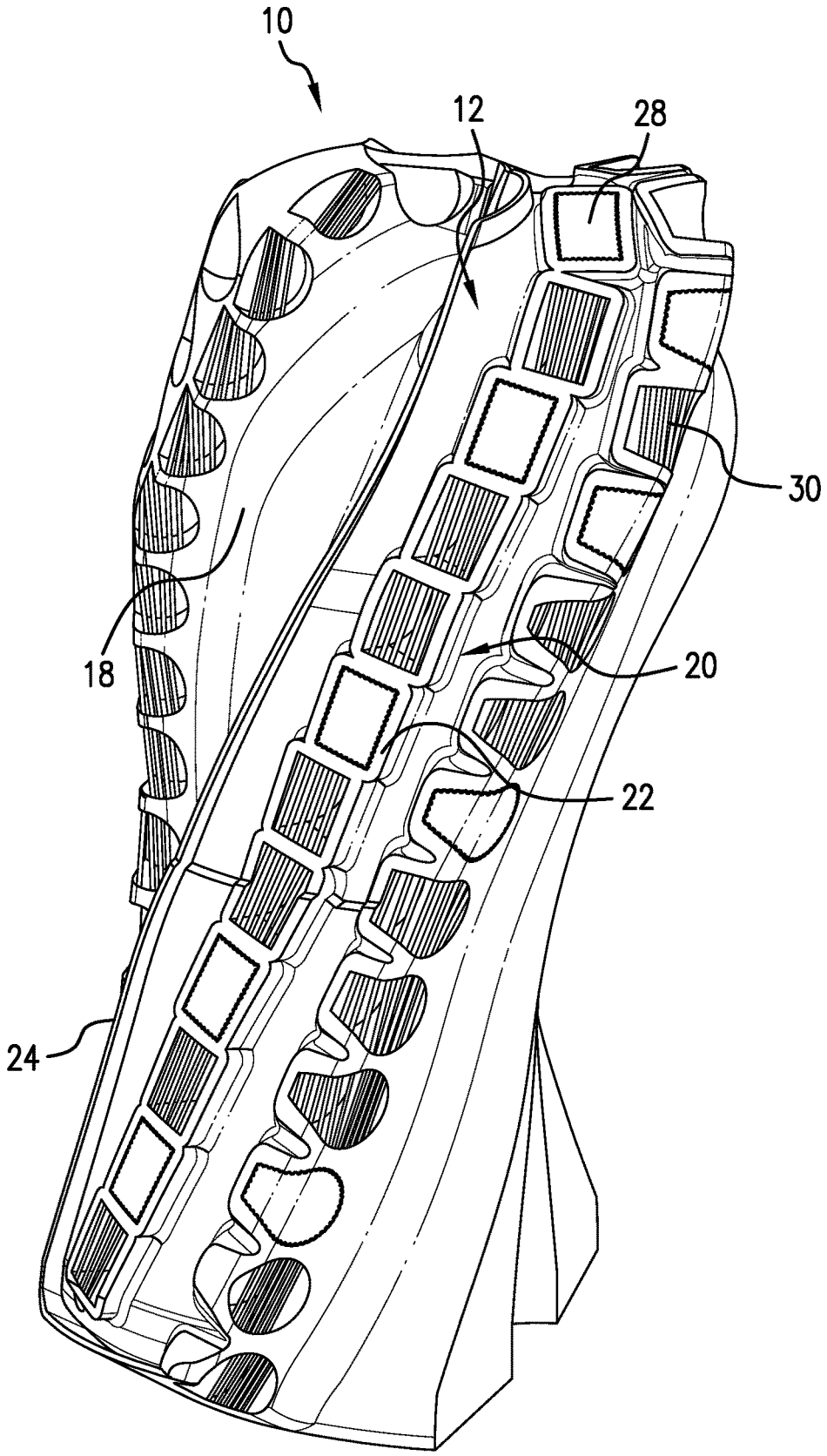
FIG. 1 is a perspective view of a drill bit body as disclosed herein.

Referring to FIG. 1, a perspective view of a drill bit body 10 is illustrated. The FIG. 1 view of body 10 is captured during a method for making a drill bit. The method includes forming the body 10, which may be done by additive manufacture or traditional manufacture, with additive manufacture being more efficient. The body 10 includes a surface 12 that will be hardfaced at an appropriate time during the overall method. The method includes the creation of all of the features described hereafter. The body 10 includes a cutter pocket 14 (a plurality are shown) that is a recess into the body 10 configured and dimensioned to receive a cutter 16 (see FIG. 2), usually by brazing. There is also a junk slot 18 disposed in the body 10. The pocket 14 is surrounded by a dam 20 that is proud of the surface 12. "Proud" should be understood to mean that the thing that is proud extends above the surface from which it emanates. In the case of the dam 20, that height ranges from about 0.062" to about 0.150" above the surface 12. The purpose of the dam is to prevent hardfacing material spilling into the pocket 14 while the hardfacing operation is under way. As will be understood, hardfacing is often a liquid application process for a drill bit and it is relatively easy for the liquid to spill into the cutter pocket 14. Preventing this spillage is important to avoiding post work that is time consuming and difficult. The dam 20 is in some embodiments of a height that is complementary to the thickness of hardfacing material that is anticipated to be placed upon the surface 12. Thereby, an edge 22 of the dam 20 would be no less than even with the hardfacing material. In this way, the spillage of hardfacing material into the pocket 14 is avoided. Similarly, hardfacing material can migrate into the junk slot 18 during the hardfacing operation, which increases costs since hardfacing a junk slot 18 is not necessary. Accordingly, an embodiment hereof forms a wall 24 alongside the junk slot 18, that wall being proud of the surface and ranging in height from about 0.062" to about 0.150" above the surface 12. Hard facing is thus prevented from spilling into the junk slot 18 during the hardfacing operation.

Also illustrated in FIG. 1 is a cover 28 for the pocket 14. The cover may be used in addition to the dam 20, in some embodiments. The cover 28 may be, for example, a thin layer of material, "thin" being about 200 micrometers thick, that essentially seals the pocket 14 so that hardfacing material may not splash into, as opposed to spill into (which is addressed by the dam 20), the pocket. Because the cover 28 is thin, it is easily knocked out, with for example, a chisel, after the hardfacing operation has been completed to allow insertion of and brazing of a cutter. The cover may be created traditionally and secured to the dam edge 22 or may be printed there as a part of an additive build of the bit body 10. If the cover 28 is printed, a support structure is needed. That support structure may be in the form of a plurality of beams 30 that have been made visible in FIG. 1 by deleting the cover 28 that would normally be disposed over the pockets 14 in some of the depictions.

Figure 2:
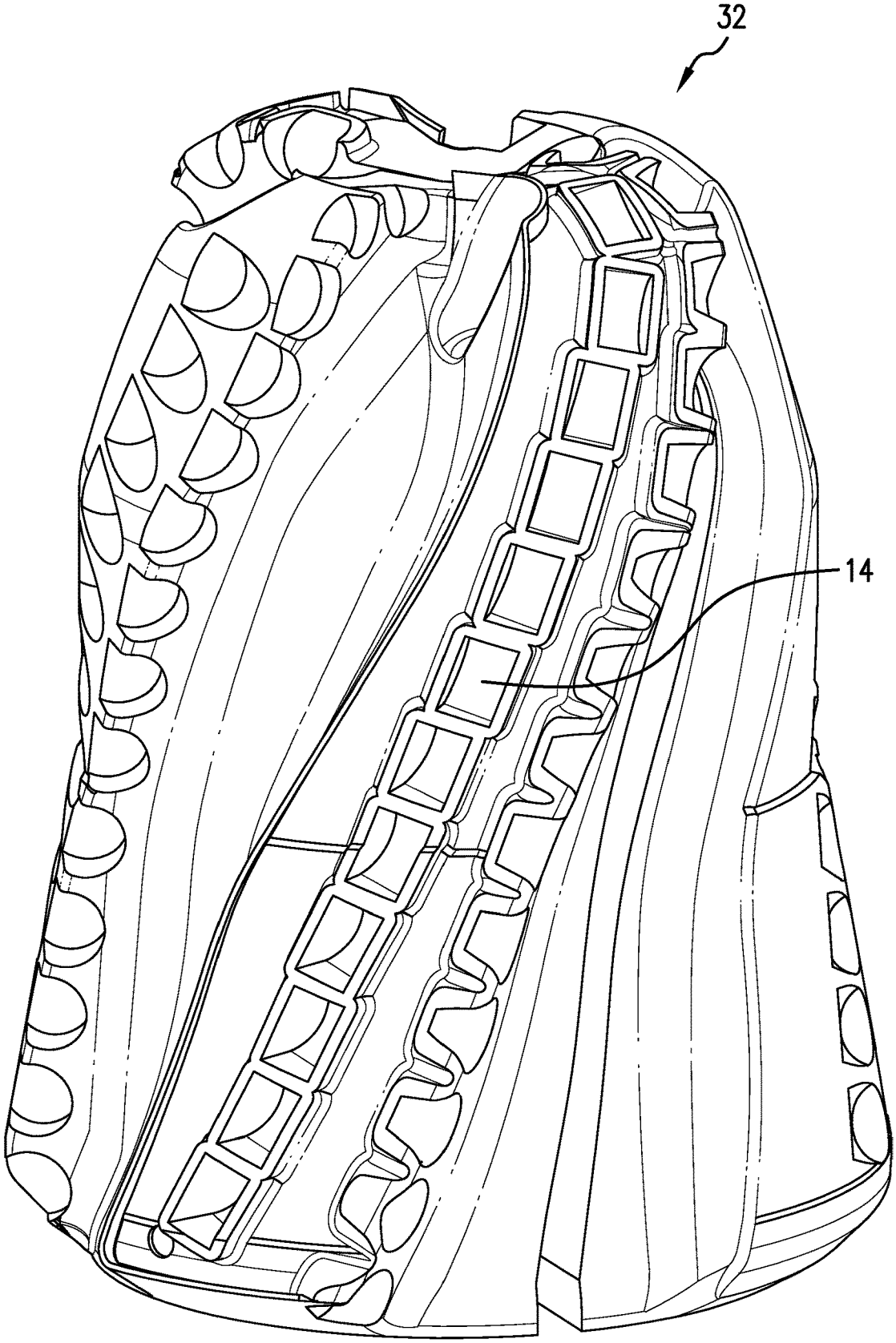
FIG. 2 is a perspective view of a completed bit created by the method disclosed herein.

Referring to FIG. 2, the completed drill bit 32 using the method described is illustrated (minus cutters that would be brazed into the cutter pockets 14 as will be familiar to those of skill in the art).

Figure 3:
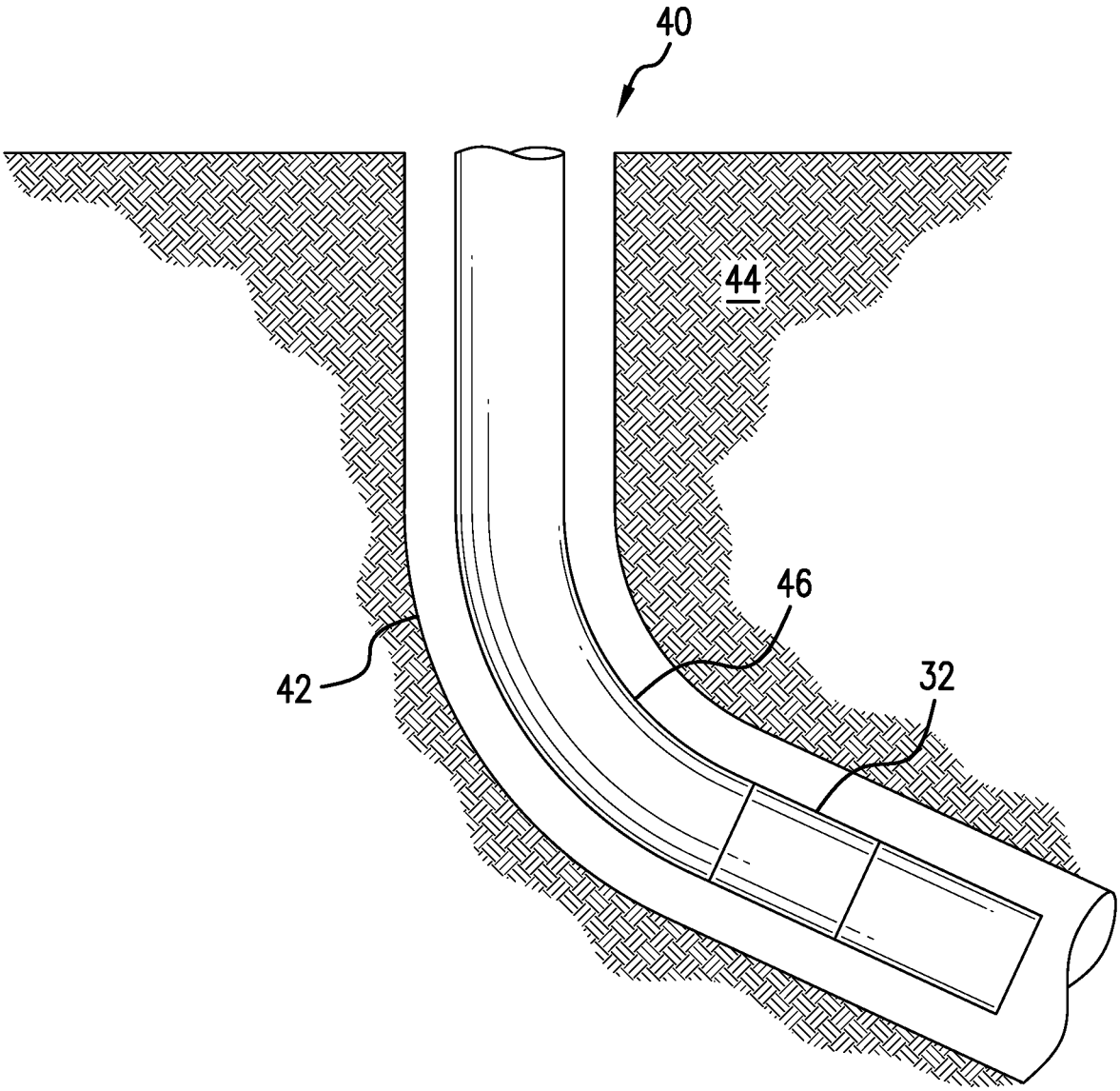
FIG. 3 is a wellbore system including the bit as disclosed herein.

Referring to FIG. 3, a borehole system 40 is illustrated. The system 40 comprises a borehole 42 in a subsurface formation 44. A string 46 is disposed within the borehole 42. A drill bit 32 as disclosed herein is disposed within or as a part of the string 46.

Set forth below are some embodiments of the foregoing disclosure:

Embodiment 1: A method for making a drill bit, including forming a bit body with an outer surface, forming a cutter pocket in the bit body, forming a dam about the cutter pocket that is proud of the surface, hardfacing the bit body to a depth not exceeding a height of the dam.

Embodiment 2: The method as in any prior embodiment, further including forming a junk slot in the body, forming a wall along the junk slot, the wall being proud of the surface, the hardfacing not exceeding a height of the wall.

Embodiment 3: The method as in any prior embodiment, further including covering the cutter pocket.

Embodiment 4: The method as in any prior embodiment, further including forming supports for the cover.

Embodiment 5: The method as in any prior embodiment, wherein the forming supports is in line with the dam.

Embodiment 6: The method as in any prior embodiment, wherein the forming the bit body is by additive manufacture.

Embodiment 7: The method as in any prior embodiment, wherein the forming the dam and/or the wall is by additive manufacture.

Embodiment 8: A drill bit, including a bit body having an outer surface, a cutter pocket defined in the bit body, and a dam disposed about the cutter pocket and proud of the outer surface.

Embodiment 9: The bit as in any prior embodiment, further comprising a junk slot and a wall along the junk slot, the wall extending proud of the outer surface.

Embodiment 10: The bit as in any prior embodiment, further comprising a cover over the cutter pocket.

Embodiment 11: The bit as in any prior embodiment, wherein the cover is supported by supports extending from the dam across the cutter pocket.

Embodiment 12: The bit as in any prior embodiment, wherein the cover is about 200 micrometers in thickness.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can-include a range of ±8% of a given value.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for making a drill bit, comprising:
forming a bit body with an outer surface;
forming a cutter pocket in the bit body;
forming a perimetrically closed dam about the cutter pocket that is proud of and integral with the surface, to prevent hardfacing material spilling into the cutter pocket during a hardfacing application;
hardfacing the bit body to a depth not exceeding a height of the dam while the pocket is empty.

2. The method as claimed in claim 1, further comprising:
forming a junk slot in the body;
forming a wall along the junk slot, the wall being proud of the surface, the hardfacing not exceeding a height of the wall.

3. The method as claimed in claim 2, wherein the forming the dam and/or the wall is by additive manufacture.

4. The method as claimed in claim 1, further comprising:
covering the cutter pocket.

5. The method as claimed in claim 4, further comprising:
forming supports for the cover.

6. The method as claimed in claim 5, wherein the forming supports is in line with the dam.

7. The method as claimed in claim 1, wherein the forming the bit body is by additive manufacture.

8. A drill bit, comprising:
a bit body having an outer surface;
a cutter pocket defined in the bit body;
a perimetrically closed dam disposed about the cutter pocket, proud of and integral with the outer surface, the dam configured to deter material spilling into the cutter pocket; and
a removable cover disposed over the cutter pocket, the pocket being empty when covered with the removable cover.

9. The bit as claimed in claim 8, further comprising a junk slot and a wall along the junk slot, the wall extending proud of the outer surface.

10. The bit as claimed in claim 8, wherein the cover is supported by supports extending from the dam across the cutter pocket.

11. The bit as claimed in claim 8, wherein the cover is up to about 200 micrometers in thickness.

12. The bit as claimed in claim 8, wherein the cover is perforated.

13. A borehole system, comprising:
a borehole in a subsurface formation;
a string disposed in the borehole;
a bit as claimed in claim 8, disposed within or as a part of the string.

* * * * *